United States Patent [19]

Antonelli et al.

[11] 4,233,140

[45] Nov. 11, 1980

[54] PROCESS FOR REGENERATING EXHAUSTED OILS

[75] Inventors: Sergio Antonelli, Peschiera Borromeo; Michele Borza, Cremona, both of Italy

[73] Assignee: Snamprogetti, S.p.A., Milan, Italy

[21] Appl. No.: 970,185

[22] Filed: Dec. 18, 1978

[30] Foreign Application Priority Data

Jan. 12, 1978 [IT] Italy ..... 19203 A/78

[51] Int. Cl.[2] ..... C10M 11/00

[52] U.S. Cl. ..... 208/180; 208/184

[58] Field of Search ..... 208/181, 182, 184, 180

[56] References Cited

U.S. PATENT DOCUMENTS

| | | | |
|---|---|---|---|
| 3,919,076 | 11/1975 | Cutler et al. | 208/184 |
| 4,073,719 | 2/1978 | Whisman et al. | 208/184 |

OTHER PUBLICATIONS

Quang et al., "Hydrocarbon Processing", Apr. 1974, pp. 129–131.

*Primary Examiner*—Herbert Levine

*Attorney, Agent, or Firm*—Morgan, Finnegan, Pine, Foley & Lee

[57] ABSTRACT

For refining spent motor oils in order to recover lubricating bases to be reused, the stock to be refined is first stripped of water and light hydrocarbons, then a first extraction with a solvent (preferably a lower paraffin), heating the oil stripped of the solvent, distilling it under vacuum to separate light, medium and heavy lubricating bases, heating the heavier lubricating base and then extracting it with the same solvent as aforesaid, and sending the lubricating bases, separately and individually, to a hydrofinishing stage. The recycle to solvent extraction of the heavy bases affords the advantage of important heat savings and the possibility of adopting blander working conditions in the hydrofinishing of the heavier lubricating bases.

9 Claims, 1 Drawing Figure

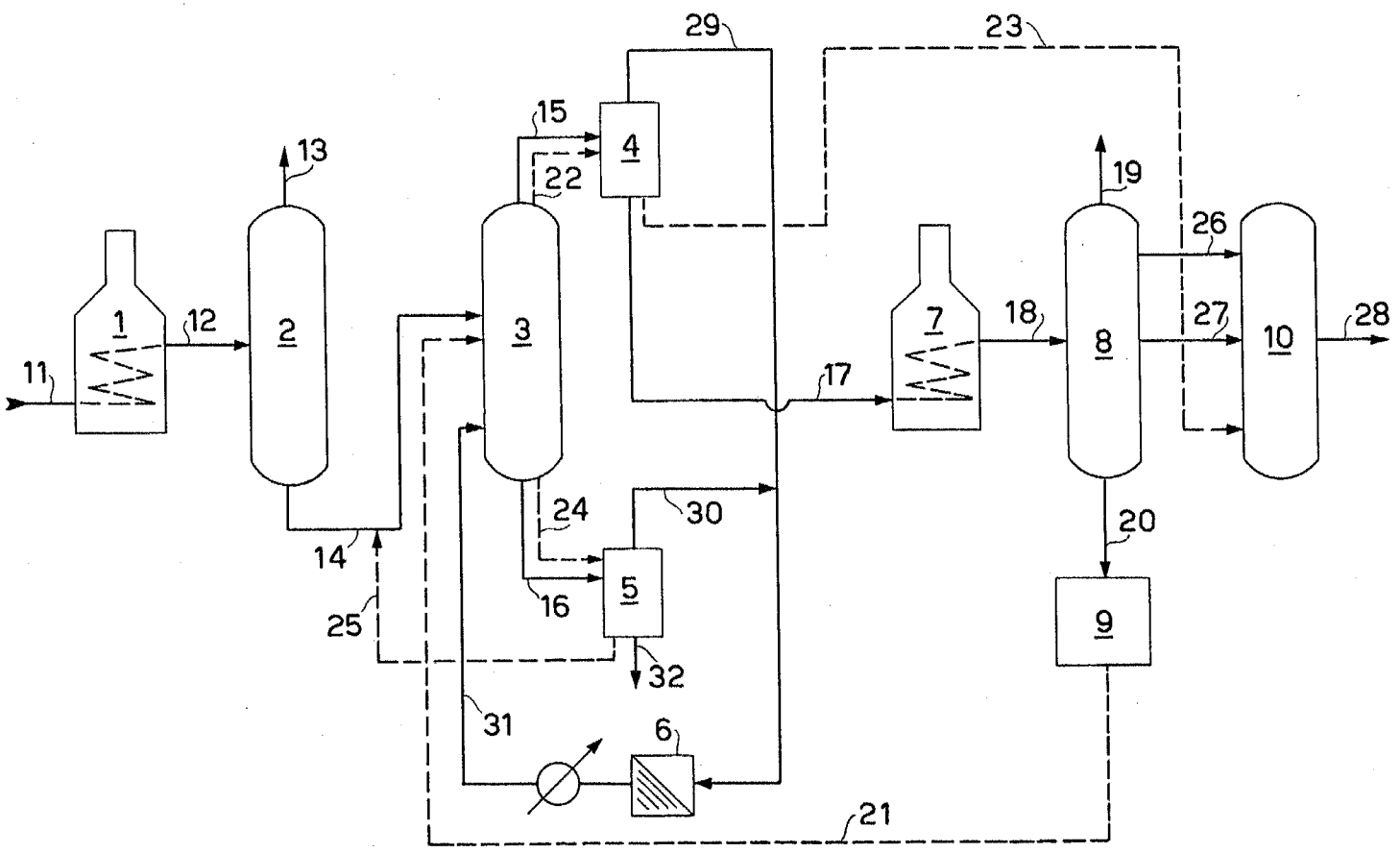
1
2
3
4
5
6
7
8
9
10
11
12
13
14
15
16
17
18
19
20
21
22
23
24
25
26
27
28
29
30
31
32

PROCESS FOR REGENERATING EXHAUSTED OILS

This invention relates to a process for regenerating exhausted oils.

More particularly, this invention relates to a process for regenerating exhausted motor oils.

It is known that the present processes for regenerating exhausted oils, more particularly exhausted motor oils, also in their more sophisticated embodiments, require the treatment with decolorizing earth and/or sulphuric acid, especially as regards the refining of the products having a high viscosity.

From these necessities, it emerges, for the refineries, the need of disposing of the exhausted decolorizing earths and/or the exhausted acidic muds, and the always severer specifications as to environmental pollution make this task more and more difficult.

In addition, such treatments are economically objectionable on account of the high cost of the decolorizing earths and sulphuric acid and on account of the low yields which can be obtained.

In the case that oil is extracted with normal paraffins and subsequent catalytic hydrogenation of the products which are thus obtained, on account of the impossibility of completely removing, by extraction, the organic metallic impurities and the products of oxidation of the oil, the result is that, in order that high-molecular weight lubricants compliant with the specifications may be obtained, it becomes necessary to resort to at least a treatment run with a decolorizing earth. Also in this case, however, the life of the hydrofinishing catalysts is extremely short.

It has been surprisingly found that the possibility of effecting the refining of all the range of the oils deriving from the refining of exhausted motor oils using, in the final stage, the hydrofinishing treatment only, that is, without resorting to the treatment with decolorizing earth and/or sulfuric acid while simultaneously achieving a better service life of the hydrofinishing catalyst, is due both to the novel type of heat treatment which is no longer directed to the entire mass of the oil to be treated, as conventionally done heretofore, but only to the heavier fraction of the oil, and to the circumstance that such heavier fraction, after the heat treatment, is subjected to an extraction with a solvent.

It is an object of the present invention to provide a process which, by adopting the following processing stages, that is, predistillation, solvent extraction, vacuum fractionation, heat treatment and solvent extraction of the high-viscosity lubricant base and hydrofinishing of the as-obtained lubricant bases, permits to obtain lubricant oils compliant with the specifications without resorting to the treatment with the earth and/or to the treatment with sulphuric acid, the hydrofinishing catalyst having concurrently an extended service life.

More particularly, the method according to the present invention comprises the following steps, viz.:

(a) Heating the oil in a first oven, (b) Sending the heated oil to a pre-distillation column and separating at the column head the water and the light hydrocarbons, (c) Recovering from the bottom of the pre-distillation column the oil which is sent to a solvent-extraction section to remove from the oil the major fraction of the impurities contained therein, (d) Heating the oil exiting the extraction section after having stripped the solvent therefrom in a second oven, (e) Feeding the oil from the heating stage to a stage of distillation under vacuum with a bottom temperature higher than 300° C., to separate from the column side the lubricating bases having the lower viscosity and deprived of impurities and discharging from the bottom the heavier lubricating base in which the remaining impurities have been concentrated, (f) Subjecting the heavier lubricating fraction to a heat treatment at a temperature from 300° C. to 450° C. under adiabatic conditions for a time varying from 1 to 120 minutes, (g) Subjecting the heavier lubricating fraction, after the heat treatment, to a second extraction with a solvent, and (h) Sending the heavy lubricating base and the other bases having a lower viscosity, separately, to a hydrofinishing stage.

According to the method of this invention, the spent oil, after having been preheated in a specially provided oven at a temperature comprised between 180° C. and 230° C. is fed to a predistillation column so as to remove from said oil the water and the light hydrocarbons.

The product which is obtained after removing the water and the light hydrocarbons is subjected to extraction with a solvent so as to remove the major fraction of the impurities contained in the oil. The solvents which are the most suitable for this step are the low molecular weight nor paraffins, with particular reference to propane, though the extraction stage might be performed with any other solvent, such as alcohols, ketones, ethers, of appropriate molecular weight which have both an insolubilizing action towards the impurities and a solvent action towards the oil. In the case of propane, the extraction can be performed in an extraction column in counterflow relationship with the oil and at a temperature in the range from 30° C. to the critical temperature of propane, under a pressure comprised between 25 and 50 kg/cm$^2$. On account of the necessity that in this stage a maximum purification of the oil is not to be performed, the ratio of the solvent to the oil is generally very reduced and is in the order of 3 to 10 volumes of propane per volume of oil.

The oil subjected to extraction in the extraction column, upon a subsequent heating, is sent to fractionation under vacuum from which the lubricating bases are recovered, as a function of their respective viscosities.

The lubricating bases having the lower viscosity, as obtained in such a fractional distillation, are directly fed to the hydrofinishing section, whereas the residue of the distillation, which consists of the high viscosity lubricating base containing a predominant fraction of the impurities, is heat treated at a temperature generally in the range from 300° C. to 450° C. and then recycled to the extraction column.

The heat treatment of the high viscosity lubricating base can also be carried out by maintaining the product, exiting the fractionation column under vacuum, under adiabatic conditions for a period of time which, consistently with the temperature, may be varied from 1 to 120 minutes. The operation is carried out in this case by inserting, immediately downstream of the column, an appropriately storage tank the volume of which will be a function of the desired stay time.

The object of the heat treatment is to modify the structure of the impurities which are still present in the oil so as to facilitate the separation of the impurities in the subsequent extraction with the solvent.

After the heat treatment by heavy lubricating base is recycled to the solvent-extraction column.

Also in this case, the preferred solvent is propane, although other kinds of solvent may be used. The extraction column can be just the same as was used for the first extraction stage and, if so, the installation will work in a batchwise fashion, but a discrete column can also be used.

The working conditions of this extraction stage are different from those used in the first extraction which had been performed on the whole oil after predistillation inasmuch as the now reduced quantity of impurities, with particular reference to those having capillary-active properties, makes the operation much more selective and much more sensitive to the variations of the working conditions. By appropriately varying the ratio of the solvent to the oil and the extraction temperature, it becomes possible to obtain a continuous and wide-range variation of the characteristics of the oil and of the quantity of residue which is produced. The working conditions can be varied within the following ranges: the extraction temperature can be comprised between 30° C. and the critical temperature of propane, the pressure can be varied from 25 kg/cm$^2$ to 50 kg/cm$^2$, whereas the ratio of the solvent to the oil can be comprised between 5 and 20 volumes of propane per volume of oil.

During this second stage different temperatures and different ratio of solvent to oil are adopted since the purpose of this second extraction is not only that of reducing the contents of metallic impurities, but also that of improving the color and thus of reducing the drastic character of the working conditions in the hydrofinish section.

The residue of this second extraction with propane can also be recycled to feed the first extraction column in order to recover the lubricating oil contained therein. The lubricating bases obtained in the previous stages are subjected to hydrofinish, hydrogen being present with catalysts based on sulphides of the metals of the VI and VIII Group of the Periodic System, supported on alumina.

The reaction temperature is comprised between 250° C. and 420° C. and the pressure is from 20 kg/cm$^2$ to 150 kg/cm$^2$, the spatial velocity is from 0.1 volumes/volume an hour and 5 v/v/hr, and the recycled hydrogen is from 15 to 850 normal liters/liter.

An advantage of the present invention over the contemporary art is that of reducing the amount of heat required for the internal consumptions of the installation. As a matter of fact the conventional refining processes resort to a heat treatment after having removed the water and the light hydrocarbons, said treatment being effected on the whole spent oil, in order to modify the structure of the impurities, with particular reference to the detergent additives which are composed of sulphonates, or phenates, of calcium, barium, magnesium and others, to make them less soluble in the lubricating oil. This operation facilitates the subsequent separation of these substances, especially if a process of precipitation by solvents is used for refining. The temperatures adopted for the heat treatment are generally very high and comprise between 300° C. and 450° C. This fact implies a considerable expenditure of heat, even upon taking into account the circumstance that a portion of the heat can be recovered for heating, for example, the charge entering the vacuum fractionation column. On the contrary, the heat treatment provided for in the processing layout of the present invention, in addition to its being performed only on the heavy lubricating base, can be performed by keeping the same base at the bottom temperature of the vacuum column, so that no heat supplements are necessary.

An additional advantage deriving from the novel type of heat treatment is the simplification of the construction of heating oven since the spent oil must be heated only to a temperature of about 200° C. as is necessary for the separation of the water and the light hydrocarbons and since at such a temperature the production of acidic gases is considerably reduced over that which is experienced in the case of the heat treatment at 300° C.–450° C.

The production of a high viscosity lubricating base which is considerably improved over that which can be obtained with the conventional regenerative processes, involves, moreover, considerable advantages in the final hydrofinishing step since the hydrogen consumption is reduced while the oil yield and the service life of the catalyst are increased.

The subject matter of this invention will now be illustrated in more detail but without limitation with reference to the layout depicted in the accompanying drawing.

Referring now to the drawing, there is schematically shown a preferred embodiment of the process of the present invention.

In the layout, the dotted lines refer only to the processing of the heavier fraction of the spent oil and more particularly to the processing that this fraction undergoes after the heat treatment. This difference in drawing the oil flow lines is due to the fact that the layout depicted herein uses a single solvent-extraction column, so that it becomes advisable to distinguish the solvent extraction of the whole oil from the extraction of the heavier lubricating base with the solvent.

From the line 11 the spent oil, coming from the storage reservoirs, is sent to the oven 1 and, via the line 12, is sent to predistillation 2. Through the head of the predistillation column 2 water and the light hydrocarbons are withdrawn through the line 13, whereas, from the bottom of 2, oil is drawn and sent via 14 to the solvent-extraction column 3.

The solvent, via the line 31, enters the neighbourhood of the extraction column 3 and, through the head 3 there are recovered, via the line 15, the oil and the major fraction of the solvent, whereas, via the line 16, the impurities and the remaining fraction of the solvent are withdrawn from the bottom of column 3. Both the streams which are withdrawn from column 3 are directly sent to 4 and 5 for recovering the solvent and the latter, via the lines 29 and 30 is sent to a compressor 6 and subsequently recycled through the line 31. The partially refined oil is sent via the line 17 to the oven 7 and then, via the line 18, to the vacuum distillation column 8.

From the head of column 8 there are withdrawn, via the line 19, the light hydrocarbons which are possibly still contained in the oil, and from the sides of the column 8, there are withdrawn the low viscosity lubricating bases: in the present layout the lubricating bases which are discharged are reduced, without limitation to this number, to two and are withdrawn via the lines 26 and 27 and sent directly to the hydrofinishing reactor 10.

From the bottom of the column 8 there is discharged via the line 20 the heavier lubricating base, in which the impurities have been concentrated, and is sent to the heat treatment 9. After a period of time which is a function of the temperature, the heavier lubricating base is sent via the line 21 to the solvent-extraction column 3.

It is apparent that in the case of a batchwise run the extraction column 3 shall be used both for the extraction of the whole oil after the predistillation and for the extraction of the heavy lubricating base upon the heat treatment, and, in such a case, the necessary storage reservoirs should be employed to carry out this kind of process, such tanks having not been shown in order not to overcrowd the drawing.

If a continuous-run installation is desired, it will suffice to insert in the installation layout a second extraction column equal to the first one.

Also in this case, through the head of the extraction column 3, the heavy lubricating base is recovered via the line 22 with the major fraction of the solvent, whereas, from the bottom of 3, via the line 24, the impurities are discharged with the remaining solvent fraction. These streams are fed to the solvent recovery at 4 and 5. From the bottom of 4 the heavy lubricating base is dumped and is fed to the hydrofinishing reactor via the line 23, whereas, through the bottom of 5 the residue is discharged which is sent (via the line 25) to be recycled as a charge to the solvent-extraction column 3 when the latter column is used for extracting the whole oil to recover oil residues still admixed with the impurities.

The streams 23, 26 and 27 are sent generally to storage reservoirs (not shown in the drawing not to overcrowd same) and then they are discretely and alternatingly sent to the hydrofinishing reactor 10 wherefrom the several lubricating bases, completely regenerated, are discharged through the line 28.

In the following, a few examples of tests made in a pilot plant are reported and they are no limitation of this invention. They clearly show the better results as obtained with the suggested method as compared with those obtainable with the conventional processes which make a heat treatment of the whole mass of the oil to be regenerated.

EXAMPLE 1

A spent motor oil has been subjected to predistillation in order to strip water and light hydrocarbons, and the residue has been subjected to heat treatment at the temperature of 380° C. for three minutes and then sent to the extraction with propane in an RDC column.

The conditions of separation employed in this stage are:

Solvent to oil ratio: 10 to 1
Column head temperature: 90° C.
Column bottom temperature: 70° C.
Pressure: 38 kg/cm$^2$ The oil extracted after stripping the propane has been subjected to vacuum fractionation for separating the several lubricating bases according to their respective viscosities. There have been obtained three lubricating bases, low-, medium-, and high-viscosity along with a certain quantity of vacuum gas oil. The light and medium lubricating bases have been treated separately with hydrogen on a catalyst based on Ni and Mo sulphides supported on alumina under the following working conditions:

Temperature: 350° C.
Pressure: 40 kg/cm$^2$
Spatial velocity: 1 volume/volume an hour
Recycle hydrogen: 168 normal liters per liter The heavy lubricating base, conversely, has been treated with hydrogen on the same catalyst but under the following working conditions:

Temperature: 350° C.
Pressure: 40 kg/cm$^2$
Spatial velocity: 0.5 volumes/volume an hour
Recycle hydrogen: 168 normal liters/liter The results which have been obtained in all the stages of the process are reported on TABLE 1.

EXAMPLE 2

A spent motor oil has been subjected to fractionation for stripping water and the light hydrocarbons, and the residue has been sent to the extraction with propane in an RDC column. The working conditions which were employed are the following:

Solvent to oil ratio: 7 to 1
Column head temperature: 90° C.
Column bottom temperature: 70° C.
Pressure: 38 kg/cm$^2$ The extracted oil, after stripping of propane, has been subjected to vacuum fractionation for the separation of the several lubricating bases according to their respective viscosities and three lubricating bases have been obtained, i.e. low-, medium-, and high-viscosity. The high-viscosity lubricating base has been subjected to heat treatment at the temperature of 350° C. for 15 mins. and then sent to the propane extraction column. In this case, the working conditions were as follows:

Solvent to oil ratio: 15 to 1
Column head temperature: 85° C.
Column bottom temperature: 73° C.
Pressure: 38 kg/cm$^2$ The light and medium lubricating bases obtained in the vacuum distillation have been treated directly with hydrogen on a catalyst composed by Ni and Mo sulphides on alumina under the following working conditions:

Temperature: 350° C.
Pressure: 40 kg/cm$^2$
Spatial velocity: 1 vol/vol an hour
Recycle hydrogen: 168 normal liters per liter The heavy lubricating base obtained from the extraction column has been treated, upon propane stripping, with hydrogen on the same catalyst as above, but under the following working conditions:

Temperature: 350° C.
Pressure: 40 kg/cm$^2$
Spatial velocity: 0.5 vol/vol an hour
Recycle hydrogen: 168 normal liters per liter The yields and the properties of the products obtained in the individual steps are reported on TABLE 2.

The comparison of the two processing runs set forth above indicates that the heavy lubricating base as obtained with the process layout according to the present invention has a smaller contents of impurities and a better colour so that it requires blander working conditions in the subsequent hydrofinishing run.

Inasmuch as the service life of the catalyst in the hydrofinishing stage is influenced by the presence of metallic impurities in the charge, which are deposited on the catalyst, the possibility of treating products having a smaller contents of impurities and a better colour permits blander working conditions and thus improves the service life of the catalyst.

TABLE 1

PROPERTIES OF THE PRODUCTS OBTAINED WITH THE HEAT TREATMENT PERFORMED ON THE WHOLE CHARGE

| | Process yield % | ASTM Colour | Viscosity cst at 210° F. | Neutr. N° mg/KOH/g | METALS, ppm (Rx fluoroscence) Ca | Ba | Zn | Pb | P | Cl | Br |
|---|---|---|---|---|---|---|---|---|---|---|---|
| (1) CHARGE | 100.0 | >8 | 14.8 | 8.6 | | | | | | | |
| (2) PREDISTILLATION and HEAT TREATMENT | | | | | | | | | | | |
| $H_2O$ | 6.9 | | | 10.52 | | | | | | | |
| Light hydrocarbons | 6.1 | | | 3.56 | | | | | | | |
| Residue | 87.0 | >8 | 14.08 | 7.7 | 1500 | 420 | 770 | 2350 | 980 | 250 | 320 |
| (3) EXTRACTION WITH PROPANE | | | | | | | | | | | |
| Refined stock | 93.66 | >8 | 10.07 | 0.34 | 10 | <5 | <5 | <5 | 35 | 49 | — |
| Residue | 6.34 | | | | | | | | | | |
| (4) VACUUM FRACTIONATION | | | | | | | | | | | |
| Gas oil | 2.84 | | | | | | | | | | |
| Light lubr. base | 26.95 | 3.5 | 5.23 | 0.48 | <5 | <5 | <5 | <5 | 45 | 60 | 43 |
| Medium lubr. base | 44.47 | 4.5 | 9.92 | 0.30 | <5 | <5 | <5 | <5 | 10 | 17 | 10 |
| Heavy lubr. base | 25.74 | >8 | 32.39 | 0.38 | 36 | <5 | 10 | 16 | 70 | 25 | <5 |
| (5) HYDROFINISHED | | | | | | | | | | | |
| Light lubr. base | 98.0 | 1.5 | 5.1 | <0.03 | <5 | <5 | <5 | <5 | 10 | <5 | <5 |
| Medium lubr. base | 98.0 | 2 | 9.5 | <0.03 | <5 | <5 | <5 | <5 | 10 | <5 | <5 |
| heavy lubr. base | 98.0 | >8 | 30.0 | <0.03 | <5 | <5 | <5 | <5 | 10 | <5 | <5 |

TABLE 2

PROPERTIES OF THE PRODUCTS OBTAINED BY HEAT TREATMENT AND RECYCLE OF THE HEAVY LUBRICATING BASE

| | Process yield % | ASTM colour | Viscosity cst at 210° F. | Neutr. N° mg/KOH/g | METALS ppm (Rx fluoroscence) Ca | Ba | Zn | Pb | P | Cl | Br |
|---|---|---|---|---|---|---|---|---|---|---|---|
| (1) CHARGE | 100.0 | >8 | 14.68 | | | | | | | | |
| (2) PREDISTILLATION | | | | | | | | | | | |
| $H_2O$ | 6.9 | | | 4.51 | | | | | | | |
| Light hydrocarbons | 3.4 | | | 2.19 | | | | | | | |
| Residue | 89.7 | | 13.27 | 3.16 | 1560 | 400 | 900 | 2600 | 850 | 650 | 580 |
| (3) FIRST EXTRACTION WITH PROPANE | | | | | | | | | | | |
| Refined stock | 94.2 | | 9.94 | 0.81 | 230 | <5 | 125 | 120 | 470 | 140 | 50 |
| Residue | 5.8 | >8 | | | | | | | | | |
| (4) VACUUM FRACTIONATION | | | | | | | | | | | |
| Light lubr. base | 28.0 | 4 | 5.15 | 0.44 | <5 | <5 | <5 | <5 | 180 | 95 | 20 |
| Medium lubr. base | 47.8 | 7 | 9.58 | 0.28 | <5 | <5 | <5 | <5 | 18 | 20 | <5 |
| Heavy lubr. base | 23.3 | >8 | 31.32 | 1.35 | 1000 | 10 | 530 | 510 | 1490 | 30 | 18 |
| (5) HEAT TREATMENT OF THE HEAVY BASE | 100.0 | | 30.5 | 1.33 | 980 | 10 | 500 | 570 | 1460 | 25 | 12 |
| (6) EXTRACTION OF THE HEAVY BASE WITH PROPANE | | | | | | | | | | | |
| Refined stock | 93.0 | <7.5 | 28.4 | 0.13 | <5 | <5 | <5 | <5 | 10 | 15 | <5 |
| Residue | 7.0 | | | | | | | | | | |
| (7) HYDROFINISHED | | | | | | | | | | | |
| Light lubr. base | 98.0 | <2 | 4.98 | <0.03 | <5 | <5 | <5 | <5 | <10 | <5 | <5 |
| Medium lubr. base | 98.0 | <2.5 | 9.3 | <0.03 | <5 | <5 | <5 | <5 | <10 | <5 | <5 |
| Heavy lubr. base | 98.0 | <4 | 28.0 | <0.03 | <5 | <5 | <5 | <5 | <10 | <5 | <5 |

We claim:

1. A process for regenerating spent oils, characterized by comprising the steps of:

(a) Heating the oil in a first oven, (b) Sending the heated oil to a pre-distillation column and separating at the column head the water and the light hydrocarbons, (c) Recovering from the bottom of the pre-distillation column the oil which is sent to a solvent-extraction section to remove from the oil the major fraction of the impurities contained therein, (d) Heating the oil raffinate exiting the extraction section after having stripped the solvent therefrom in a second oven, (e) Feeding the oil from the heating stage to a stage of distillation under vacuum with a bottom temperature higher than 300° C., to separate from the column side the lubricating bases having the lower viscosity and deprived of impurities and discharging from the bottom the heavier lubricating bases in which the remaining impurities have been concentrated, (f) Subjecting the heavier lubricating fraction to a heat treatment at a temperature from 300° C. to 450° C. under adiabatic conditions for a time varying from 1 to 120 minutes, (g) Subjecting the heavier lubricating fraction, after the heat treatment, to a second extraction with solvent, and (h) Sending the heavy lubricating base raffinate and the other bases having a lower viscosity, separately, to a hydrofinishing stage.

2. A process according to claim 1, wherein the solvent used in the extraction section is normal paraffin having a low molecular weight.

3. A process according to claim 1, wherein the solvent-extraction of the whole oil and of the heavier lubricating base takes place alternatingly in the same extraction section and, in such a case, the storage tanks necessary for this kind of process must be provided.

4. A process according to claim 1, characterized in that the oil in the first oven is heated to a temperature comprised between 180° C. and 230° C.

5. A process according to claim 1, wherein the residue coming from the solvent-extraction stage of the heavier lubricating base is recycled as a charge to the extraction column together with the whole oil upon predistillation.

6. A process according to claim 1, wherein the solvent extraction section operates at a temperature comprised between 30° C. and the critical temperature of the normal paraffin which is employed.

7. A process according to claim 1, wherein the extraction section operates under a pressure comprised between 25 $kg/cm^2$ and 50 $kg/cm^2$.

8. A process according to claim 1, wherein the extraction of the oil coming from the predistillation stage is carried out with volume ratios of the normal paraffin per volume of oil of from 3 to 10.

9. A process according to claim 1, wherein the extraction of the heavier lubricating base is carried out with volume ratios of the normal paraffin per volume of oil variable from 5 to 20.

* * * * *